US007380425B2

(12) United States Patent
Elliott et al.

(10) Patent No.: US 7,380,425 B2
(45) Date of Patent: Jun. 3, 2008

(54) LOCK WITH MOVABLE SHROUD

(75) Inventors: Joe Elliott, Mequon, WI (US); Horst Lebecht, Surprise, AZ (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 11/283,396

(22) Filed: Nov. 18, 2005

(65) Prior Publication Data

US 2006/0162402 A1 Jul. 27, 2006

Related U.S. Application Data

(60) Provisional application No. 60/629,062, filed on Nov. 18, 2004.

(51) Int. Cl.
*E05B 67/38* (2006.01)
*E05B 67/00* (2006.01)

(52) U.S. Cl. ..... 70/56; 70/38 R; 70/52; 70/54; 70/DIG. 43

(58) Field of Classification Search ..... 70/35, 70/38 R, 38 A, 38 B, 38 C, 51–52, 54–56, 70/DIG. 43
See application file for complete search history.

(56) References Cited

U.S. PATENT DOCUMENTS

| | | | | |
|---|---|---|---|---|
| 1,016,455 A | | 2/1912 | Stone | |
| 3,754,419 A | | 8/1973 | Taylor | |
| 3,783,657 A | * | 1/1974 | Foote | 70/52 |
| 3,835,675 A | | 9/1974 | Lippisch | |
| 3,882,699 A | | 5/1975 | Flack et al. | |
| 4,290,280 A | * | 9/1981 | Yun | 70/38 A |
| 4,548,058 A | * | 10/1985 | Bahry et al. | 70/56 |
| 4,689,975 A | | 9/1987 | Dunphy et al. | |
| D296,519 S | | 7/1988 | Newman et al. | |
| 4,763,496 A | * | 8/1988 | Evans et al. | 70/52 |
| 4,776,187 A | * | 10/1988 | Evans et al. | 70/52 |
| D314,908 S | | 2/1991 | Pedersen | |
| D315,090 S | | 3/1991 | Pedersen | |
| 5,146,771 A | * | 9/1992 | Loughlin | 70/56 |
| 5,219,384 A | * | 6/1993 | Elsfelder et al. | 70/18 |
| D342,009 S | | 12/1993 | Lebrecht et al. | |
| 5,655,391 A | * | 8/1997 | Chen | 70/56 |

(Continued)

OTHER PUBLICATIONS

Master Lock, Solid Brass Padlocks Product No. 6830 Description, Master Lock web site.

(Continued)

*Primary Examiner*—Patricia Engle
*Assistant Examiner*—Christopher Boswell
(74) *Attorney, Agent, or Firm*—Calfee, Halter & Griswold LLP

(57) ABSTRACT

A lock having a movable shroud for protecting a lock shackle is disclosed. The lock includes a lock body, a locking mechanism attached to the lock body, a shackle and a shroud. The shackle has a first portion disposed within the lock body and a second portion movable between a locked position and an unlocked position. The shroud is attached to the lock body and is movable between a retracted position and an extended position. In the extended position, the shroud covers at least a portion of the shackle that extends beyond the lock body. The lock may include corresponding detents and openings on adjacent lock body and shroud surfaces to guide the movement of the shroud relative to the lock body. A method of use is also disclosed.

40 Claims, 7 Drawing Sheets

U.S. PATENT DOCUMENTS

| | | | | |
|---|---|---|---|---|
| D406,043 | S | 2/1999 | LeClaire | |
| D411,730 | S | 6/1999 | Matyko | |
| 5,931,030 | A * | 8/1999 | Chen | 70/56 |
| D423,908 | S | 5/2000 | Liu | |
| D429,993 | S | 8/2000 | Liu | |
| D432,391 | S | 10/2000 | Heppner | |
| 6,374,646 | B1 * | 4/2002 | Brake | 70/56 |
| 6,393,876 | B1 * | 5/2002 | Matyko | 70/56 |
| D470,743 | S | 2/2003 | Koy | |
| D484,777 | S | 1/2004 | Ruan | |
| 6,679,086 | B1 * | 1/2004 | Hart, Jr. | 70/56 |
| 6,684,668 | B1 * | 2/2004 | Hsueh Lee | 70/56 |
| 6,705,134 | B2 * | 3/2004 | Miranda | 70/56 |
| 7,021,092 | B2 * | 4/2006 | Loughlin et al. | 70/56 |
| D524,145 | S * | 7/2006 | Heppner | D8/343 |
| 2005/0028569 | A1 * | 2/2005 | Turek | 70/14 |
| 2005/0132764 | A1 * | 6/2005 | Loughlin et al. | 70/56 |

OTHER PUBLICATIONS

Master Lock, Solid Brass Padlocks Product No. 6850 Description, Master Lock web site.

International Preliminary Report on Patentability and Written Opinion from PCT/US2005/042218 dated May 31, 2007, 7 pages.

* cited by examiner

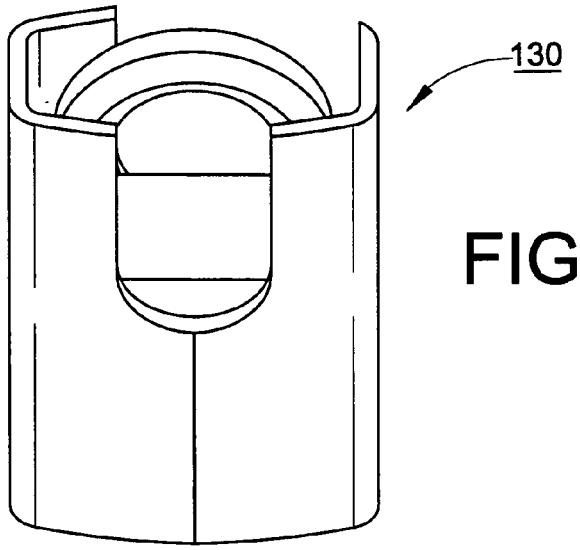
FIG. 6a
FIG. 6b
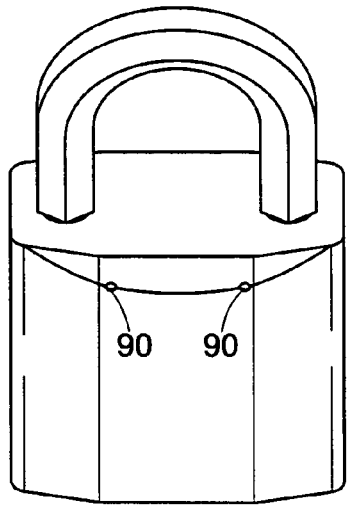
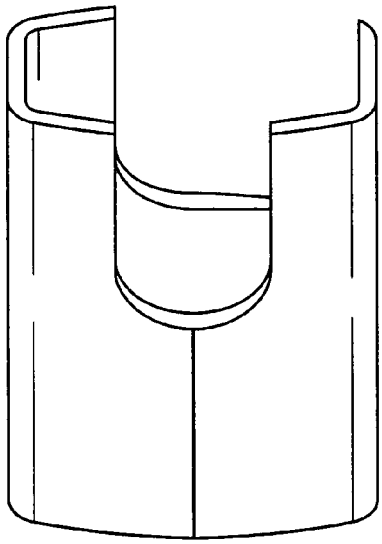
FIG. 6c

LOCK WITH MOVABLE SHROUD

CROSS-REFERENCE TO RELATED APPLICATIONS

This non-provisional application claims the benefit of U.S. Provisional Patent Application No. 60/629,062, entitled "Lock with Movable Shroud," filed Nov. 18, 2004, which is hereby incorporated in its entirety.

FIELD OF THE INVENTION

The present invention is directed to a lock and more particularly to a lock that has a movable shroud for protection of a shackle.

BACKGROUND OF THE INVENTION

Padlocks, combination locks, and other types of conventional locks are known in the art for use in a variety of applications. Locks may be used by an owner to secure many different objects against theft or accidental misplacement. Many locks, such as for example, padlocks and cable locks, often include a lock body and a shackle. The shackle may be placed through a set of apertures, around a hasp, a locking point or otherwise attached to an object to be secured.

A shackle is one lock component that may be susceptible to compromise, either through weather, misuse, or damage. Consequently, certain locks have been provided with a shroud or protective covering over a portion of the shackle. Shrouds of this type are typically molded into the body of the lock and thus form one continuous integral piece. In application, the shroud protects the shackle from being cut, damaged or otherwise compromised.

The lock of the present invention incorporates a movable shroud. As such, the lock can be selectively changed from a standard lock to a shrouded lock. In the shrouded position, at least a portion of the shackle extending beyond the lock body is covered by a protective covering. The flexibility of the shroud position allows for a operator to vary the position of the shroud dependent on the application condition of the lock. The shroud also advantageously locks when in the extended position when the shackle is locked. The shroud may also be moved between positions without unlocking the shackle.

SUMMARY OF THE INVENTION

In several illustrated embodiments of the present invention, a lock including a movable shroud is disclosed. The lock can be selectively changed from a standard lock to a shrouded lock. The lock may be of any known style, such as for example, a padlock, a dial combination lock, a door lock or a cable lock, and include a locking mechanism of any known type, such as for example, a multiple pin cylinder or a wafer cylinder lock.

Further features and advantages of the invention will become apparent from the following detailed description made with reference to the accompanying drawings.

BRIEF DESCRIPTION OF THE DRAWINGS

FIGS. 6*a*-6*c* are perspective views of a lock constructed in accordance with yet another embodiment of the present invention, showing a lock having a lock body with detent receiving openings on an outer surface thereof;

DETAILED DESCRIPTION OF THE INVENTION

Figure 1:
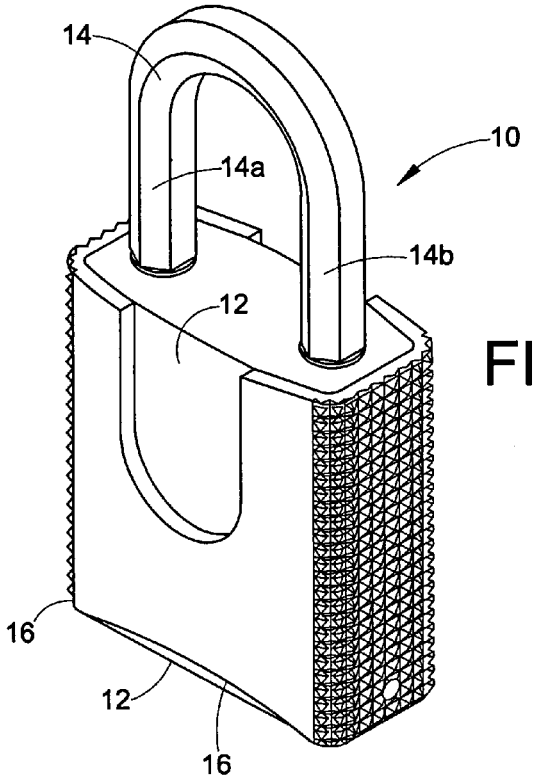
FIG. 1 is a perspective view of a lock constructed in accordance with an embodiment of the present invention, showing a lock having a movable shroud with the shroud in a retracted position.

The Detailed Description of the Invention merely describes preferred embodiments of the invention and is not intended to limit the scope of the claims in any way. Indeed, the invention as described by the claims is broader than and unlimited by the preferred embodiments, and the terms in the claims have their full ordinary meaning.

A lock including a movable shroud is disclosed. The shroud can generally be moved between a retracted position and an extended position. In the retracted position, the lock functions as a standard lock and in the extended position the shroud covers at least a portion of the shackle extending beyond the lock body. The method or structure that is used to move the shackle can take the shape or configuration of a variety of embodiments. The disclosure herein includes examples of the present invention and this application is not meant to restrict the invention to any specific structure.

In general, movement and location of the shroud is controlled by relative movement between the shroud and the lock body. One or more detents, such as for example, ball bearings, roller bearings, pins, or levers, can be used to secure the shroud in either the upward position or the downward position. The detents are received in holes, openings, slots, depressions or the like in the complementary piece. For example, if the detents are located in the body of the lock, then the openings are located along the inner side walls of the shroud. It should be appreciated that the detents should secure the shroud in both positions. For example, in an embodiment a single detent located near the top of the lock body is used and openings for receiving the detent are placed at the top and at the bottom of the inner side walls of the shroud. As such, the detent sits within the lower opening when the shroud is in the extended position, and sits within the upper opening when the shroud is in the retracted position. It should be appreciated that multiple detents can be used and that the detents can be positioned in a number of different positions, so long as the detents secure the shroud in at least the extended position.

The shroud is used to protect the shackle in the locked position. Consequently, the detents need to lock the shroud in the extended position when the shackle is secured within the lock body. As such, when the shroud is in the extended position and the shackle is secured within the lock body, the detent is prevented from being withdrawn from the opening in the shroud. Since the detent cannot be withdrawn, the shroud cannot be moved from the extended position to the retracted position. For example, in an embodiment the shackle holds the detent in the opening in the shroud. In such embodiment the insertion of the shackle into the lock body provides the means for securing the detent in the opening. Only upon removal of the shackle from the lock body will the detent be allowed to be moved from the opening in the shroud. In other embodiments, the detents can be secured within the openings in the shroud by a member of the locking mechanism, or a piece that is connected to the locking mechanism. In such embodiments, the movement of the lock mechanism, such as the turning of the lock cylinder after insertion of a proper key, allows for the movement of the detents from the openings in the shroud.

Relative direction and length of motion between the shroud and the lock body can be accomplished in numerous ways. One such way is a slot on the lock body and a corresponding pin or ridge in the shroud. Alternatively, the slot can be in the shroud and the pin or ridge can be in the lock body. The corresponding slot and ridges can be along the sides of the lock body and shroud, or they can be located on the front and back surfaces of lock body and shroud, or a combination thereof. The pin or ridge is received within the slot and provides a guide for the movement of the shroud. Further, the ends of the slot act as stops to limit the movement of the shroud.

Referring now to the drawings, FIG. 1 is a perspective view of a lock 10 constructed in accordance with an embodiment of the present invention. The lock 10 generally includes a lock body 12, a shackle 14, a movable shroud 16 and a locking mechanism, not shown. The shroud 16 is illustrated in a retracted position and in this position, the lock 10 functions as a standard padlock, thereby allowing full access to the section of the shackle extending beyond the lock body.

Figure 2:
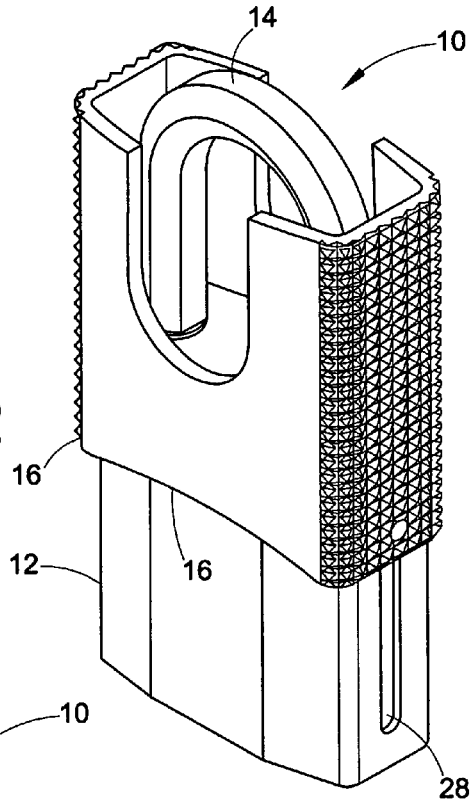
FIG. 2 is a perspective view of the lock of FIG. 1, showing the shroud in an extended position.

FIG. 2 is a perspective view of the lock 10 of FIG. 1. In this view, the shroud 16 is illustrated in an extended position to cover portions 14*a*, 14*b* of shackle extending beyond and adjacent to the lock body 12. In this position, the lock 10 functions as a shrouded lock to provide protection to at least a portion of the shackle.

Figure 3:
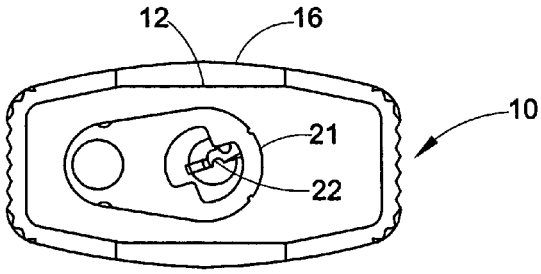
FIG. 3 is a bottom view of the lock of FIG. 1, showing a lock body having a key slot.
Figure 4A:
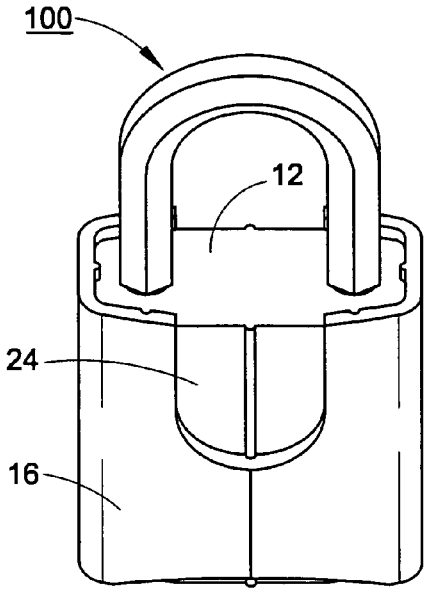
FIGS. 4*a*-4*d* are perspective views of a lock constructed in accordance with another embodiment of the present invention, showing a lock having a lock body with ridges on an outer surface thereof.
Figure 4B:
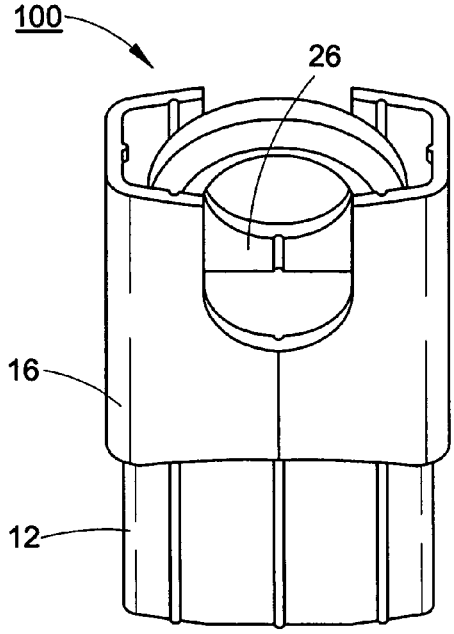
Figure 4C:
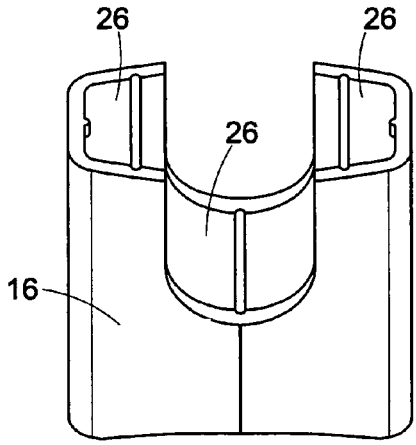
Figure 4D:
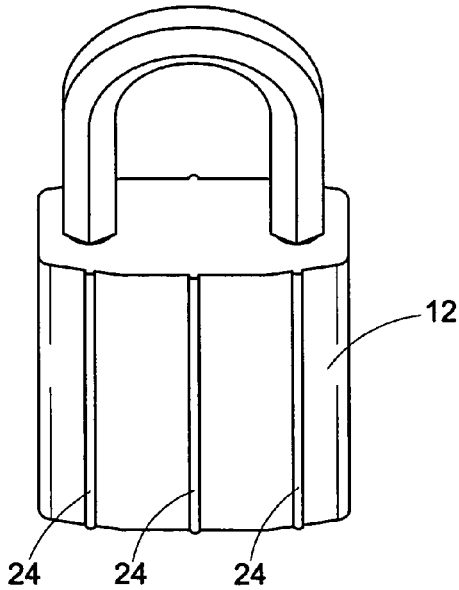
Figure 9:
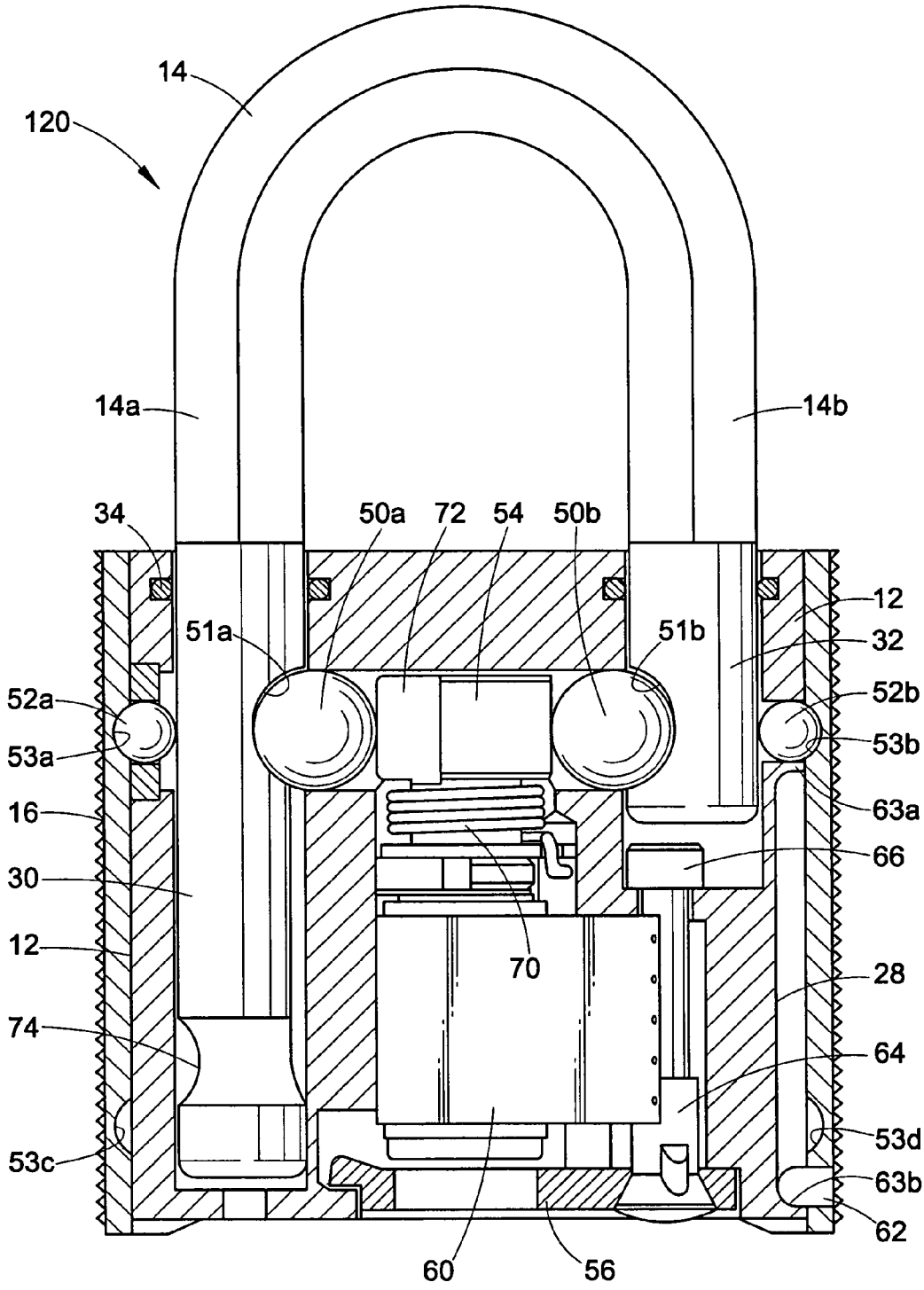
FIG. 9 is an enlarged view of FIG. 8.

As discussed, the lock 10 includes a lock body 12 and as shown is in the general form of a padlock. It should be apparent that other lock styles and lock body shapes can be used in the practice of the present invention. The lock body 12 may be constructed of steel, hard plastic, or any other suitably durable material. A locking mechanism, such as for example, a locking mechanism including a lock cylinder 60 as best shown in FIG. 9, is attached to the lock body 12. In the embodiment shown, the locking mechanism is fixed to an interior of the lock body 12. FIG. 3 is a bottom view of the lock body 12, showing a lock cylinder door 21 having a key slot 22 that is operable with insertion of a proper key.

The lock body 12 is formed to allow selective and relative motion between the lock body 12 and the shroud 16. One exemplary lock body is shown in FIGS. 4*a*-4*d*. The lock body 12 has plurality of ridges 24 on an outer surface thereof. It should be apparent to one with ordinary skill in the art that any number of ridges, ridge spacing, or ridge locations can be used in the practice of the present invention. The ridges 24 shown are formed to cooperatively engage slots 26 defined by an inner surface on the shroud 16. As a result, the slots 26 provide a guide path for relative movement of the shroud 16 with respect to the lock body 12. Other constructions are possible in the practice of the present invention. For example, a slot 28, best seen in FIG. 2, may be formed in the outer surface of the lock body to cooperatively engage with an engagement member, such as for example, a ridge or pin fixed to the shroud. It should be apparent to others with ordinary skill in the art that other guidance structure to effect relative motion between the shroud 16 and the lock body 12 is possible in the practice of the present invention.

Referring now to FIGS. 6*a*-6*c*, perspective views of a lock 130 constructed in accordance with yet another embodiment of the present invention are show. The lock 130 has a lock body 12 with detent receiving openings 90 on an outer surface thereof. The openings 90 can receive an engagement member that permits shroud movement independent of the shackle being unlocked.

Figure 8:
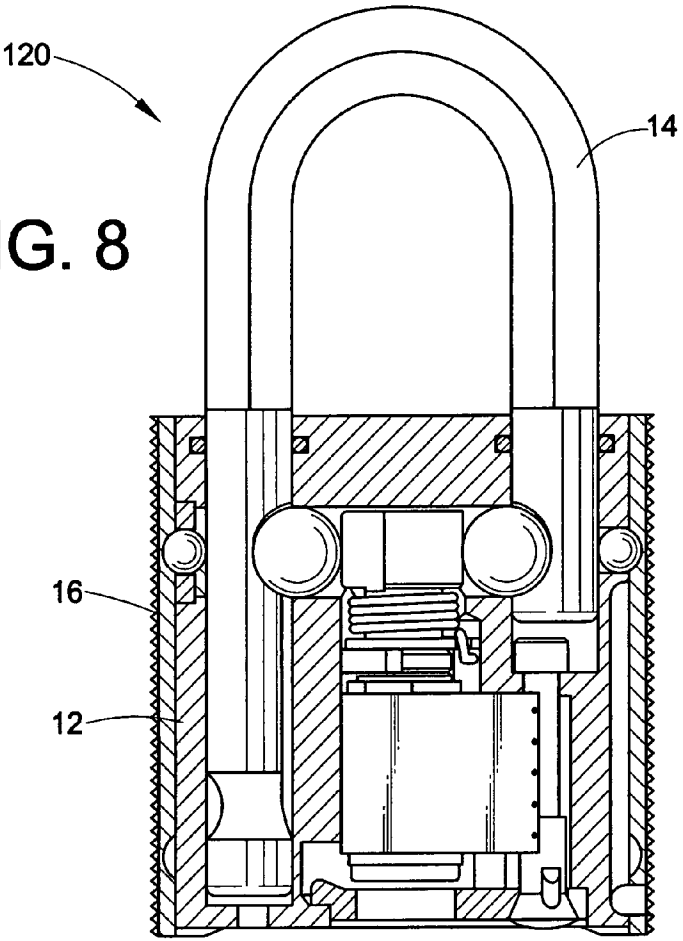
FIG. 8 is a front view, partially in section, of the lock of FIG. 7 as seen along the line 8-8 in FIG. 7, showing the shackle in a locked position.

The lock 10 includes a shackle 12 that is partially covered or protected by the shroud 16 in an extended position. As illustrated in FIGS. 8 and 9, the shackle 12 is U-shaped and hex-sided. It should be apparent to others with ordinary skill in the art that any shape, size, or style of shackle can be used in the practice of the present invention, such as for example, a cable. A first portion or longer leg 30 of the shackle 14 is disposed within the lock body 12. A second portion or shorter leg 32 is movable between a locked position, shown in FIG. 9 and an unlocked position. In the unlocked position, not shown, the second leg 32 extends beyond the lock body 12. As seen in FIG. 9, an o-ring 34 bounds each leg 30, 32 adjacent an entry point into the lock body 12. The o-rings provide protection to the interior of the lock 10 against moisture, dirt and other elements.

As mentioned, the lock 10 includes a shroud 16 attached to the lock body and selectively movable between a retracted position and an extended position. The shroud 16 may be constructed of steel, hard plastic, or any other suitably durable material. It should be apparent to others with ordinary skill in the art that a shroud may be any covering, lining, shield or object that provides some protection to the shackle.

Referring to FIGS. 1-2, the shroud 16 shown is a uniform piece that is movable between retracted and extended positions. In other embodiments, the shroud can be moved in other ways, other than the upward and downward movement as described above. For example, the shroud may be split in two, thereby allowing an outward pivoting of each half of the shroud. In such an embodiment, there would be a central pivot point on each side of the lock body and shroud connection. When the shroud is to be moved, the upper portion of the shroud can be pulled outward away from the lock body and pivoted about the central pivot point. Each shroud half can continue to pivot until flush with the lock body. The shroud pieces can then be pivoted back to obtain the shrouded position. A mechanism or blocker can then be used to prevent pivoting of the shroud pieces when the shackle is in the locked position. Again, this can be done with the positioning of the shackle or the relative positioning of the lock mechanism. It should be appreciated that is merely one additional type shroud movement and that this invention contemplates other shroud movement mechanisms.

Figure 5A:
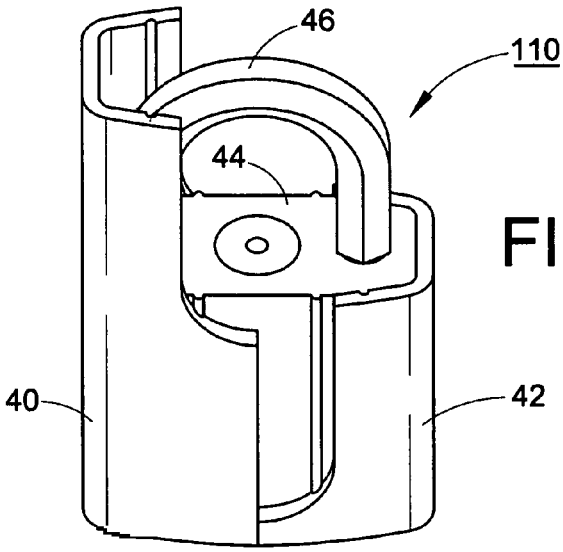
FIGS. 5*a*-5*c* are perspective views of a lock constructed in accordance with yet another embodiment of the present invention, showing a lock having a split shroud with multiple portions.
Figure 5B:
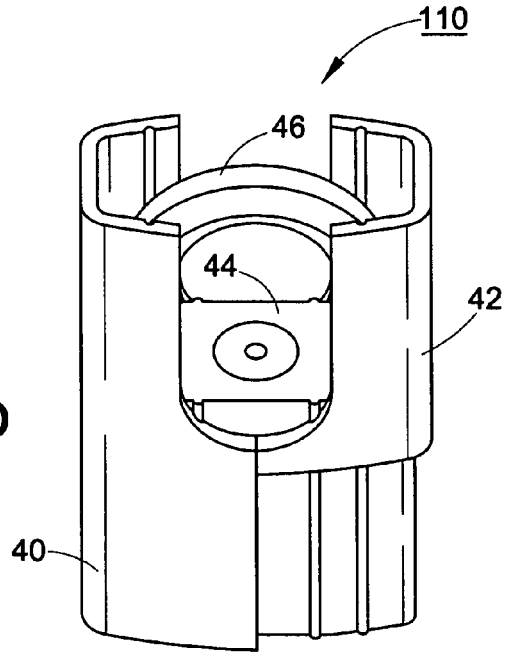
Figure 5C:
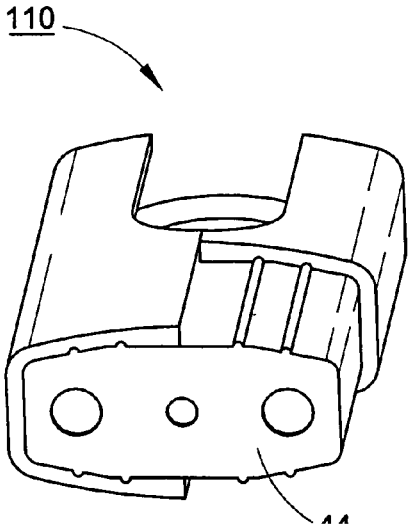

Other shroud styles can be constructed in the practice of this invention. FIGS. 5*a*-5*c* show a lock 110 having a split shroud with multiple portions 40, 42. A larger shroud portion 40 is fixed to the lock body 44. A smaller shroud portion 42 is selectively movable between a retracted position shown in FIG. 5*a* and an extended position shown in FIGS. 5*b*-5*c*. In alternative embodiments, each shroud portion 40, 42 can be independently movable with respect to the lock body 44. It should be apparent to others with ordinary skill in the art that any number of fixed or movable shroud portions can be used in the practice of the present invention.

Figure 7:
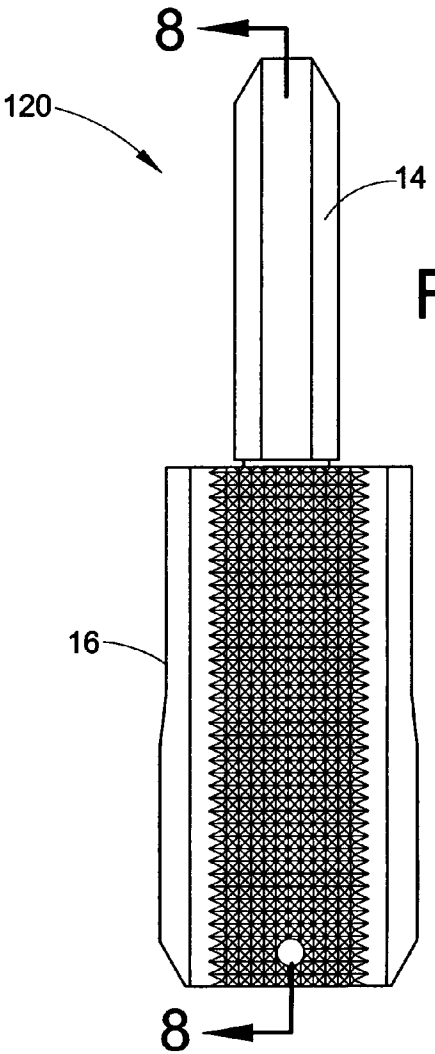
FIG. 7 is a side view of a lock constructed in accordance with yet another embodiment of the present invention.

Referring now to FIG. 7, a side view of a lock 120 constructed in accordance with yet another embodiment of the present invention is illustrated. The lock is shown with the shackle 14 in a locked position. A front view, partially in section, of the lock of FIG. 7 as seen along the line 8-8 in FIG. 7, is shown in FIG. 8. Operation of the lock 120 will be discussed in reference to FIG. 9, an enlarged view of FIG. 8.

The shackle 14 is shown in a locked position in FIG. 9. Two detents or shackle bearings 50*a*, 50*b* engage cooperatively shaped and disposed cavities 51*a*, 51*b* defined by the inner surfaces of the first leg 30 and second leg 32, respectively. This engagement prevents linear movement of the shackle 14 in the direction $A_1$. Other locking structure can be used in secure the shackle in place, such as for example, the detents and cavities may be of a different shape, style, or orientation.

Still referring to FIG. 9, the shroud 16 is shown in the retracted position. Two detents or shroud bearings 52*a*, 52*b* are shown, one on either opposing edge of the lock body 12. The bearings 52*a*, 52*b* engage cooperatively shaped and disposed cavities 53*a*, 53*b* defined by the inner surface of the shroud 16. While the shackle 14 is locked, this engagement prevents linear movement of the shroud 16 in the direction $A_1$. Two other cooperatively shaped cavities 53*c*, 53*d* are located near the bottom inner edge of the shroud 16. The bearings 52*a*, 52*b* engage these cavities 53*c*, 53*d* when the shroud 12 is in the extended position. Other locking structure can be used in secure the shroud in place, such as for example, the detents and cavities may be of a different shape, style, or orientation. Further, any combination of shackle bearings and shroud bearing can be used in the practice of this invention.

To move the shroud 16 from the retracted position in FIG. 9 to the extended position in FIG. 2, a proper key is inserted into a lock mechanism. The lock mechanism shown includes a lock cylinder 60, a rotational spring 70 and a cylinder extension assembly 54. The lock cylinder is a conventional multiple pin lock cylinder 60 held in place by a cylinder door 56, a screw 66 and nut 64. After an operator inserts and rotates a proper key, the cylinder extension assembly 54 rotates a quarter turn. It should be apparent to others with skill in the art that the mechanics of the key, the lock cylinder, and the rotation angle amount can vary and be any suitable design known in the art. After rotation of the cylinder extension assembly 54, surface cavities 72 in the assembly 54 align with the shackle bearings 50*a*, 50*b*. A operator can apply force to the shackle in the direction $A_1$ to open the shackle 12. In this position, the shackle 14 is in the unlocked position.

When the shackle reaches a fully extended position, the shroud bearings 52*a*, 52*b* are no longer held against the shroud cavities surfaces 53*a*, 53*b*. Specifically, shroud bearing 52*a* is free to move inward and contact cavity surface 74 on the outer surface of the shackle first leg 30. Further, shroud bearing 52*b* is not bound on the inward side. Consequently, an operator may move the shroud 16 in FIG. 9 to the extended position once the shackle 14 has been unlocked and pulled to a fully extended position. As such, the shroud can be slid in a direction $A_1$ until a pin 62 contacts a top surface 63*a* of the slot 28. In this arrangement, the shroud bearings 52*a*, 52*b* cooperatively align with the cavities 53*c*, 53*d*, respectively. In this arrangement, the shroud 16 is in its extended position.

The shackle 12 and shroud 14 can be locked in place by operator manipulation of the shackle 14. An operator applies a force on the shackle in a direction opposite $A_1$ to close the shackle. The spring 70 is biased to rotate the cylinder extension assembly 54 back to its original position. When the shackle 14 moves sufficiently into the lock body, the shackle bearings 50*a*, 50*b* engage the shackle inner cavities 51*a*, 51*b* as the bearings are rotated back to their original position. Effectively, the shackle 14 is locked in place and the shroud is locked in the extended position by bearings 52*a* and 52*b* being forced into cavities 53*c* and 53*d*, respectively.

The shroud 16 can be moved from the extended position to the retracted position by essentially reversing the above described steps. To move the shroud 16 from the extracted position in FIG. 2 to the retracted position in FIG. 9, a proper key is inserted into the lock mechanism. After a operator inserts and rotates the key, the cylinder extension assembly 54 rotates a quarter turn. After rotation of the cylinder extension assembly 54, surface cavities 72 in the assembly 54 align with the shackle bearings 50*a*, 50*b*. A operator can apply force to the shackle 16 in the direction $A_1$ to open the shackle 12.

An operator may move the shroud 16 in FIG. 2 to the retracted position once the shackle 14 has been unlocked and pulled to a fully extended position. As such, the shroud 16 can be slid in a direction opposite $A_1$ until a pin 62 contacts a bottom surface 63*b* of the slot 28. In this arrangement, the shroud bearings 52*a*, 52*b* cooperatively align with the cavities 53*a*, 53*b*, respectively. In this arrangement, the shroud 16 is in its retracted position. The shackle 12 and shroud 14 may be locked in place by operator manipulation of the shackle 14 downward into the locked position. Effectively, the shackle 14 is locked in place and the shroud is locked in the retracted position by bearings 52*a* and 52*b* being forced into cavities 53*a* and 53*b*, respectively.

In another embodiment of the present invention, the shackle can be moved between the retracted and extended positions without unlocking the shackle. In a lock of this style, the cylinder extension assembly 54 includes four cavities for receiving bearings. Two opposing cavities engage detents in the shroud and two other opposing cavities engage detents in the shackle. An operator can rotate the locking mechanism to disengage the shroud without disengaging the shackle. After the shroud is pulled to the extended position and the locking mechanism rotates back to its biased position, a rotation spring biases the cylinder extension assembly 54 to a position in which the shroud is locked.

Figure 10:
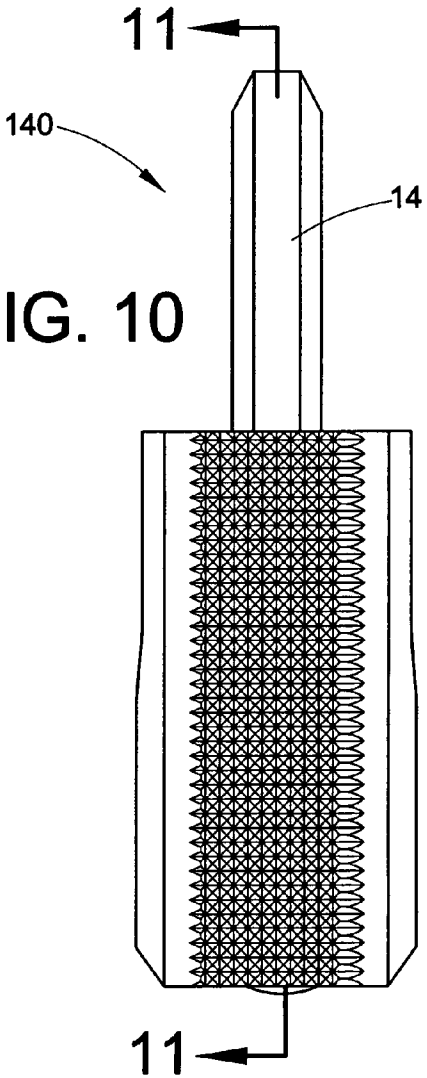
FIG. 10 is a side view of a lock constructed in accordance with yet another embodiment of the present invention.
Figure 11:
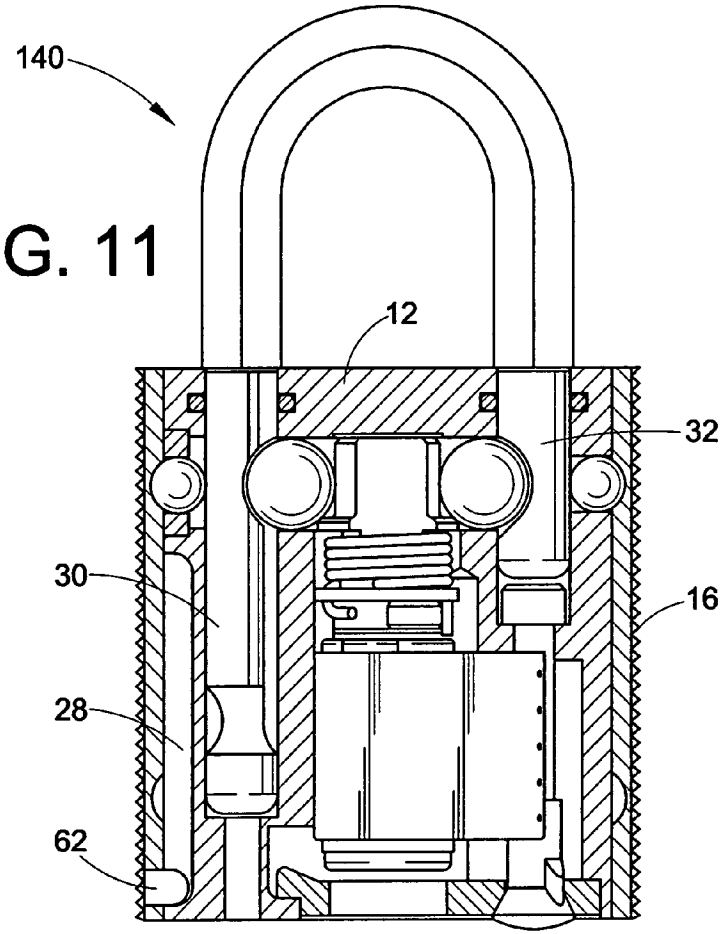
FIG. 11 is a front view, partially in section, of the lock of FIG. 10 as seen along the line 11-11 in FIG. 10, showing the shackle in a locked position.

Referring now to FIG. 10, a side view of a lock 140 constructed in accordance with yet another embodiment of the present invention is illustrated. The lock is shown with the shackle 14 in a locked position. A front view, partially in section, of the lock of FIG. 10 as seen along the line 11-11 in FIG. 7, is shown in FIG. 11. The lock body has a slot 28 for guiding relative movement of the shroud. The slot 28 is located on the side of the lock 140 of the long shackle leg 30. It should be apparent to others with ordinary skill in the art that the lock body or shroud can have any number of slots or slot locations in the practice of the present invention.

While several embodiments of the invention has been illustrated and described in considerable detail, the present invention is not to be considered limited to the precise constructions disclosed. Various adaptations, modifications and uses of the invention may occur to those skilled in the arts to which the invention relates. It is the intention to cover all such adaptations, modifications and uses falling within the scope or spirit of the claims filed herewith.

What is claimed is:

1. A lock comprising:

a) a lock body;

b) a locking mechanism attached to said lock body;

c) a shackle extending axially from the lock body, the shackle having a first portion disposed within said lock body and a second portion movable between a locked position and an unlocked position; and d) a shroud attached to said lock body and axially movable between a retracted position and an extended position, the shroud covering at least a portion of an outermost outward facing side surface of the lock body in the retracted position;

e) wherein said shroud in said extended position covers at least a portion of said shackle extending beyond said lock body.

2. The lock of claim 1 wherein said locking mechanism prohibits movement of said shroud from said extended position to said retracted position when said shackle is in said locked position.

3. The lock of claim 1 wherein said locking mechanism prohibits movement of said shroud from said retracted position to said extended position when said shackle is in said locked position.

4. The lock of claim 1 wherein said locking mechanism engages said shackle in said locked position and prohibits shackle movement to said unlocked position.

5. The lock of claim 1 wherein said shackle can be moved from said unlocked position to said locked position when said shroud is in said extended position.

6. The lock of claim 1 wherein said shackle is movable between said locked position and said unlocked position by manipulation of said locking mechanism.

7. The lock of claim 1 wherein said locking mechanism is unlocked by insertion of a proper key.

8. The lock of claim 1 wherein said shroud comprises a plurality of portions, wherein at least one portion is movable between a retracted position and an extended position, wherein said at least one portion in said extended position covers at least a portion of said shackle extending beyond said lock body.

9. The lock of claim 1 wherein a cross-section of said shackle is hexagonal.

10. The lock of claim 1 wherein said lock body has at least one slot on an outer surface thereof, wherein said slot provides a guide path for relative movement of said shroud with respect to said lock body.

11. The lock of claim 1 wherein said lock body has at least one ridge on an outer surface thereof, wherein said ridge provides a guide path for relative movement of said shroud with respect to said lock body.

12. The lock of claim 1 wherein said shroud has at least one slot on an inner surface thereof.

13. The lock of claim 1 wherein said shroud has at least one ridge on an inner surface thereof.

14. The lock of claim 1 further comprising a detent disposed in said lock body to secure said shroud in said extended position, wherein said detent is received into an opening in an inner surface of said shroud.

15. The lock of claim 14 wherein said detent is a bearing.

16. The lock of claim 1 further comprising a detent disposed in said lock body to secure said shroud in said retracted position, wherein said detent is received into an opening in an inner surface of said shroud.

17. The lock of claim 1 further comprising a detent to secure said shroud in said extended position to said lock body, wherein said detent is received into an opening in an outer surface of said lock body.

18. The lock of claim 17 wherein said detent is a bearing.

19. The lock of claim 1 further comprising a detent to secure said shroud in said retracted position to said lock body, wherein said detent is received into an opening in an outer surface of said lock body.

20. A lock comprising:

a) a lock body;

b) a shackle extending axially from the lock body, the shackle having a first leg disposed within said lock body and a second leg movable between an open position outside of said lock body and a closed position within said lock body;

c) a locking mechanism attached to said lock body for securing said shackle in said closed position; and d) a shroud attached to an outermost side surface of said lock body and axially movable between an extended position and a retracted position, wherein said locking mechanism engages said shroud in said extended position and prohibits shroud movement to said retracted position;

e) wherein said shroud in said extended position covers at least a portion of said shackle that extends beyond said lock body when said shackle is in said closed position.

21. The lock of claim 20 wherein said shackle is moveable between said locked position and said unlocked position by manipulation of said locking mechanism.

22. The lock of claim 20 wherein said lock body has at least one slot on an outer surface thereof, wherein said slot provides a guide path for relative movement of said shroud with respect to said lock body.

23. The lock of claim 20 further comprising a detent disposed in said lock body to secure said shroud to said lock body in said extended position, wherein said detent is received into an opening in an inner surface of said shroud.

24. The lock of claim 23 wherein said detent is a bearing.

25. The lock of claim 20 further comprising a detent disposed in said lock body to secure said shroud to said lock body in said retracted position, wherein said detent is received into an opening in an inner surface of said shroud.

26. A lock comprising:

a) means for securing a shackle to a lock body, the shackle extending axially from the lock body;

b) means for attaching a shroud to said lock body; and c) means for axially moving said shroud between an extended position and a retracted position;

d) wherein said shroud in said extended position covers at least a portion of said shackle that extends beyond said lock body;

e) further wherein said shroud in said retracted position covers at least a portion of an outermost outward facing side surface of the lock body.

27. A method for protecting a lock shackle in a lock, said lock comprising: a lock body, a lock mechanism attached to said lock body, and a shackle extending axially from the lock body, the shackle having a first portion disposed within said lock body and a second portion movable between a locked position and an unlocked position, the method comprising the steps of:

a) providing a shroud in a retracted position relative to the lock body, such that the shroud covers at least a portion of an outermost outward facing side surface of the lock body;

b) moving said shackle to said unlocked position;

c) axially moving said shroud to said extended position relative to said lock body;

d) moving said shackle to said locked position; and e) locking said shroud in said extended position.

28. The method of claim 27 further comprising the step of covering at least a portion of said shackle that extends beyond said lock body when the shroud is in the extended position.

29. The method of claim 27 further comprising the step of manipulating said locking mechanism prior to moving said shackle to said unlocked position.

30. The method of claim 27 further comprising the step of stopping the movement of said shroud relative to said lock body when a detent disposed in said lock body engages with an opening in an inner surface of said shroud.

31. A lock comprising:

a lock body;

a locking mechanism attached to said lock body;

a shackle extending axially from the lock body, the shackle having a first portion disposed within said lock body and a second portion movable between a locked position and an unlocked position; and a shroud attached to said lock body and axially movable between a retracted position and an extended position;

wherein said shroud in said extended position covers at least a portion of said shackle extending beyond said lock body; and wherein said locking mechanism prohibits movement by an applied force of said shroud from said retracted position to said extended position when said shackle is in said locked position.

32. A lock comprising:

a lock body;

a locking mechanism attached to said lock body;

a shackle having a first portion disposed within said lock body and a second portion movable between a locked position and an unlocked position; and a shroud attached to said lock body and movable between a retracted position and an extended position;

wherein said shroud in said extended position covers at least a portion of said shackle extending beyond said lock body; and wherein the lock body further comprises at least one slot in an outward facing side surface, the at least one slot being configured to provide a guide path along a full range of movement of the shroud between the retracted and extended positions.

33. The lock of claim 32, wherein said shroud includes at least one engagement member on an inner surface thereof the at least one engagement member cooperatively engaging the at least one slot of the lock body.

34. The lock of claim 33, wherein said at least one engagement member comprises a ridge.

35. The lock of claim 33, wherein said at least one engagement member comprises a pin.

36. A lock comprising:

a lock body;

a locking mechanism attached to said lock body;

a shackle having a first portion disposed within said lock body and a second portion movable between a locked position and an unlocked position; and a shroud attached to said lock body and movable between a retracted position and an extended position;

wherein said shroud in said extended position covers at least a portion of said shackle extending beyond said lock body; and wherein the lock body further comprises at least one ridge extending outward from an outward facing side surface, the at least one ridge being configured to provide a guide path for movement of the shroud.

37. The lock of claim 36, wherein said shroud includes at least one slot on an inner surface thereof the at least one slot cooperatively engaging the at least one ridge of the lock body.

38. A lock comprising:

a lock body;

a shackle extending axially from the lock body, the shackle having a first leg disposed within said lock body and a second leg movable between an open position outside of said lock body and a closed position within said lock body;

a locking mechanism attached to said lock body for securing said shackle in said closed position; and a shroud axially movable between an extended position and a retracted position with respect to the lock body, wherein said shroud is configured to be secured in said extended position by at least one detent disposed between the shroud and an outermost outward facing side surface of the shackle.

39. The lock of claim 38, wherein said shroud is configured to be secured in said retracted position by the at least one detent.

40. The lock of claim 38, wherein movement of the shackle to the open position causes the detent to disengage from the shroud, allowing movement of the shroud relative to the lock body.

* * * * *